US006331239B1

(12) United States Patent
Shirota et al.

(10) Patent No.: US 6,331,239 B1
(45) Date of Patent: Dec. 18, 2001

(54) METHOD OF ELECTROPLATING NON-CONDUCTIVE PLASTIC MOLDED PRODUCTS

(75) Inventors: Hideki Shirota, Kyoto; Jun Okada, Osaka, both of (JP)

(73) Assignee: Okuno Chemical Industries Co., Ltd., Osaka (JP)

( * ) Notice: Subject to any disclaimer, the term of this patent is extended or adjusted under 35 U.S.C. 154(b) by 0 days.

(21) Appl. No.: 09/147,292

(22) PCT Filed: Apr. 7, 1997

(86) PCT No.: PCT/JP97/01187

§ 371 Date: Nov. 20, 1998

§ 102(e) Date: Nov. 20, 1998

(87) PCT Pub. No.: WO98/45505

PCT Pub. Date: Oct. 15, 1998

(51) Int. Cl.[7] ..... C25D 5/56; C23C 28/02
(52) U.S. Cl. ..... 205/167; 205/187
(58) Field of Search ..... 205/167, 187; 106/1.18, 1.26

(56) References Cited

U.S. PATENT DOCUMENTS

| | | | | |
|---|---|---|---|---|
| 3,871,889 | | 3/1975 | Fadgen, Jr. et al. | 106/1 |
| 4,581,256 | * | 4/1986 | Sommer | 427/305 |
| 4,617,205 | | 10/1986 | Darken | 427/305 |
| 4,655,833 | | 4/1987 | Amelio et al. | 106/1.23 |
| 4,707,377 | | 11/1987 | Capwell et al . | 427/8 |
| 4,948,707 | | 8/1990 | Johnson et al. | 430/11 |
| 5,213,841 | | 5/1993 | Gulla et al. | 427/98 |
| 5,262,042 | | 11/1993 | Okabayashi | 205/210 |
| 5,543,182 | | 8/1996 | Joshi et al. | 427/443.1 |
| 5,645,628 | | 7/1997 | Endo et al. | 106/1.23 |
| 5,795,828 | | 8/1998 | Endo et al. | 438/678 |

FOREIGN PATENT DOCUMENTS

| | | | |
|---|---|---|---|
| 2 109 013 | | 5/1983 | (GB) . |
| 2134931A | | 8/1984 | (GB) . |
| 55-22552 | | 6/1980 | (JP) . |
| 56-16179 | | 4/1981 | (JP) . |
| 2-1912 | | 1/1990 | (JP) . |
| 2-14430 | | 4/1990 | (JP) . |
| 2-24910 | | 5/1990 | (JP) . |
| 2-27436 | | 6/1990 | (JP) . |
| 3-267393 | | 11/1991 | (JP) . |
| 3-76599 | | 12/1991 | (JP) . |
| 5-44075 | | 2/1993 | (JP) . |
| 5-148662 | * | 6/1993 | (JP) . |
| 5-221637 | * | 8/1993 | (JP) . |
| 7-197266 | | 8/1995 | (JP) . |
| 2-83796 | | 3/1996 | (JP) . |
| WO 95/14538 | | 6/1995 | (WO) . |

* cited by examiner

*Primary Examiner*—Edna Wong
(74) *Attorney, Agent, or Firm*—Armstrong, Westerman, Hattori, McLeland & Naughton LLP

(57) ABSTRACT

A method of electroplating non-conductive plastic moldings, the method comprising the steps of: applying a catalyst useful for electroless plating to non-conductive plastic moldings using a colloidal solution containing a precious metal compound and a stannous compound; forming an electrically conductive coating on the surface of the moldings using an electroless copper plating solution containing a copper compound, a saccharide having a reducing property, a complexing agent and an alkali metal hydroxide; and electroplating the coated moldings. According to the method, an electroplated coating excellent in appearance and properties can be formed on non-conductive plastic moldings by a simple procedure.

5 Claims, No Drawings

METHOD OF ELECTROPLATING NON-CONDUCTIVE PLASTIC MOLDED PRODUCTS

This is a national stage application of Ser. No. PCT/JP97/01187 filed Apr. 7, 1997.

FIELD OF THE INVENTION

The present invention relates to a method of electroplating non-conductive plastic moldings and an electroless copper plating solution suitable for use in said electroplating method.

BACKGROUND ART

Among methods of electroplating non-conductive plastic moldings to form a decorative coating, a widely employed method comprises, in succession, degreasing, etching, optionally neutralizing and pre-dipping, then applying a catalyst for electroless plating using a colloidal solution containing a tin compound and a palladium compound, and optionally activating (accelerator treatment), followed by electroless plating and electroplating.

In such plating method, electroless copper plating solutions are frequently used which contain a reducing agent having a high reducing power such as paraformaldehyde. When this electroless copper plating solution is used, copper is deposited in the initial plating stage on a highly catalytic palladium portion of tin/palladium colloid coating applied as the catalyst. However, copper is continuously deposited by reduction due to the reducing action of the reducing agent with high reducing power and thus a copper layer is formed not only on the palladium portion but also in the transverse direction. As a result, copper is also deposited on an inherently non-catalytic tin portion so that a so-called bridge deposit is formed which is likely to provide a spongy coating. When electroplating is conducted on the electrolessly plated coating having the bridge deposit, pit-like fine agglomerates (called stardust) are partially deposited in a great number, thereby tending to render the coating irregular. The plated coating thus formed on the plastic substrate often shows an inferior appearance compared with a plated coating on a metallic substrate.

To prevent the creation of such inferior appearance, attempts have been made to brush the surface of the substrate electrolessly plated with copper before electroplating. However, the attempt is disadvantageous in involving a cumbersome step.

Further, the electroless copper plating solution contains, as a reducing agent, paraformaldehyde which is highly toxic and presumably carcinogenic. A further problem is that considerable labor is entailed in removing the metal ions in the disposal of waste water because a completing agent having a high complexing power such as EDTA has been used to solubilize the copper ions.

When electroless nickel plating is conducted in place of electroless copper plating, stardust scarcely develops because of a lesser degree of bridge deposits so that the resulting electroplated coating is esthetically superior in appearance to the electroplated coating formed on the electrolessly plated copper coating. However, electroless nickel plating disadvantageously requires more catalyst than electroless copper plating, thereby incurring higher costs. Further, when copper electroplating is conducted after electroless nickel plating, the nickel coating is eroded by the galvanic potential difference due to lower potential of the nickel coating than the copper coating, thereby tending to induce coat peeling and resulting in blisters.

A method is known which comprises immersing a substrate in a colloidal solution containing a precious metal to deposit a colloid coating of precious metal, and directly electroplating the coated substrate without conducting electroless plating (Japanese Unexamined Patent Publication No.267393/1991). However, this method is defective as follows. Since the coating has a low electrical conductivity and electroplating proceeds at a low deposition rate, the feeding points of electrical power require a large area when plastic moldings of great area are electroplated. Furthermore, a substantial time is taken to electroplate the entire substrate surface of such plastic moldings and it is difficult to form a uniform coating over the entire substrate surface. Moreover, the procedure is performed under narrowly limited conditions, and the control of treating solutions and the working conditions are very cumbersome.

DISCLOSURE OF THE INVENTION

A primary object of the present invention is to provide a method of electroplating non-conductive plastic moldings by a simple procedure, the method being capable of forming a coating excellent in appearance and properties.

The present inventors conducted extensive research in view of the foregoing prior art problems and found the following. A suitable electrically conductive coating can be formed without developing a bridge deposit by a method comprising applying a catalyst useful for electroless plating to non-conductive plastic moldings, and electrolessly plating the moldings using an electroless copper plating solution of novel makeup containing a saccharide having a reducing property as a reducing agent. Further, when the surface of said electroless-plated coating is directly electroplated, a decorative coating of excellent appearance can be easily formed. Since the electroless copper plating solution to be used in this method contains a saccharide with relatively low reducing power as a reducing agent, a high stability of the plating solution is assured and the solution can be easily controlled. In addition, because a hydantoin compound having a relatively low complexing power can be used as a complexing agent for copper, the electroless copper plating solution has excellent properties including high deposition capability and ease of effluent treatment. Based on these novel findings, the present invention was accomplished.

According to the present invention, there are provided:

(1) a method of electroplating non-conductive plastic moldings, the method comprising the steps of: applying a catalyst useful for electroless plating to non-conductive plastic moldings using a colloidal solution containing a precious metal compound and a stannous compound; forming an electrically conductive coating on the surface of the moldings using an electroless copper plating solution containing a copper compound, a saccharide having a reducing property, a complexing agent and an alkali metal hydroxide; and electroplating the coated moldings: and (2) an electroless copper plating solution which is an aqueous solution comprising 0.1 to 5 g/l, calculated as copper metal, of a copper compound, 2 to 50 g/l of a complexing agent, 3 to 50 g/l of a saccharide having a reducing property and 10 to 80 g/l of an alkali metal hydroxide.

There is no limitation on the type of non-conductive plastic moldings to be treated by the method of the invention. A highly decorative plated coating can be easily formed even on large-size moldings having a great area. For example, the method of the invention can be applied to plastic automotive components recently widely used in the automobile industry. Examples of such large-size plastic materials include front grilles, emblems and other automotive parts, exterior components of electronic devices, knobs and like parts to be electroplated for decoration, materials to be plated for giving corrosion resistance or for adding a new function, etc.

The kind of plastic materials to be treated is not limited, and various plastic materials heretofore known can be treated. Examples of plastics are general-purpose plastics heretofore extensively used for chemical plating such as ABS resins, general-purpose engineering plastics having a heat resistance at a temperature of 150° C. or less, such as polyamides (nylon PA), polyacetals (POM), polycarbonates (PC), modified polyphenylene ethers (PPE), polybutylene terephthalates (PBT) and the like, super engineering plastics having a heat resistance at a temperature of 200° C. or more, such as polyphenylene sulfides (PPS), polyether sulfones (PES), polyether imides (PEI), polyether ether ketones (PEEK), polyimides (PI), liquid crystal polymers (LCP) and the like, polymer alloys such as polycarbonate/ABS and the like. It is suitable to use, among these plastics, plastics of a grade proper for plating such as ABS resins and the like which can avoid the decrease in the adhesion of the plated coating and the degradation of coating appearance by means of etching or other pretreatment of the plastics.

In the plating method of the invention, first, a pretreatment is conducted in the conventional manner. Namely the surface of a substrate to be treated is cleaned to remove extraneous matter such as fingerprints, fats and oils and like organic substances, dust deposited due to electrostatic action and so on. Conventional degreasing agents can be used as a treating solution. Degreasing is conducted in the conventional manner using a conventional degreasing agent, for example, an alkaline degreasing agent or the like.

Subsequently the surface of the substrate to be treated is etched when so required. The etching treatment selectively dissolves the surface of resin substrate to achieve an anchor effect. This treatment can improve the adhesion of the plated coating, the appearance of the coating surface and the like. The etching procedure is carried out by conventional methods. For example, the substrate to be treated is immersed in a properly heated mixed solution of chromic acid and sulfuric acid. When a substrate of ABS resin is treated, the etching treatment dissolves out polybutadiene as the constituent due to oxidative effect of chromic acid, giving anchor pores of about 1 to about 2 $\mu$m in pore size to the resin substrate, while the polybutadiene is caused to undergo oxidative decomposition, producing a polar group such as a carbonyl group. Consequently a colloidal solution containing a precious metal compound and a stannous compound is easily adsorbed in the subsequent step.

When substrates of general-purpose engineering plastics or super engineering plastics are treated, they are often difficult to etch and, therefore, are preferably pre-etched in the conventional manner prior to etching, when so required. The pre-etching treatment swells a skin layer or a crystal-oriented layer on the surface of the resin substrate using an organic solvent. The pre-etching can be conducted usually using a solvent of high polarity such as dimethyl sulfoxide. The pre-etching treatment can enhance the etching effect.

Also, resin substrates containing inorganic materials, glass fibers and the like can be treated by a proper etching method selected from conventional methods.

After etching, the resin substrate is washed to remove the etching solution such as chromic acid or the like remaining on the surface of resin substrate. The chromic acid can be easily removed from the surface when cleaning is effected using a diluted solution of hydrochloric acid or a solution containing a reducing agent such as sodium bisulfite.

Subsequently a catalyst useful for electroless plating is applied to the substrate to be treated using a colloidal solution containing a precious metal compound and a stannous compound. Conventional catalyst solutions useful for electroless plating can be used as the colloidal solution. Such conventional catalyst solutions usually contain a precious metal compound such as a platinum compound, gold compound, palladium compound, silver compound and the like which are known to have a catalytic property for electroless plating. Specific examples of the platinum compound to be incorporated in the catalyst solution include chloroplatinate. Specific examples of the gold compound are chloroaurate and salt of gold sulfite. Specific examples of the palladium compound are palladium chloride and palladium sulfate. Specific examples of the silver compound are silver nitrate and silver sulfate. The precious metal compounds can be used either alone or in combination. It is preferred in the invention to use a catalyst solution containing a palladium compound as the precious metal compound. The amount of the precious metal compound used is not limited. A suitable amount is about 100 to about 500 mg/l calculated as metal.

Preferred examples of the stannous compound to be incorporated in said colloidal solution are stannous chloride and stannous sulfate. These compounds can be used alone or in combination. Among them, stannous chloride is preferred. The amount of the stannous compound used may be usually about 10 to about 50 g/l calculated as tin metal and is about 50 to about 120 times the weight of the precious metal.

Usually the colloidal solution is about 1 or less in pH, i.e., strongly acidic, and can be prepared in the conventional manner. For example, a precious metal compound and a stannous compound are individually dissolved in an acid solution and the resulting solutions are mixed together to give a colloidal solution. For use, the obtained colloidal solution can be properly adjusted to a suitable concentration. Examples of the acid solution useful in said procedure are a hydrochloric acid solution, a sulfuric acid solution, a mixed solution of hydrochloric acid and sulfuric acid, a hydrochloric acid solution containing sodium chloride, a sulfuric acid solution containing sodium chloride, a mixed solution of hydrochloric acid and sulfuric acid containing sodium chloride, etc.

Said colloidal solution may further contain copper lower aliphatic monocarboxylate, copper bromide or the like. It is preferable to use a divalent copper compound as the copper compound because of its high solubility. Of the copper lower aliphatic monocarboxylates, copper formate and copper acetate are preferred. When these compounds are used, a stable colloidal solution can be formed and can easily adhere in the form of a uniform film to the substrate to be treated. The amount of the copper compound used is preferably about 0.2 to about 3 g /1, more preferably about 0.5 to about 2 g/l, calculated as copper metal.

Especially preferred colloidal solutions useful as a catalyst solution include, for example, an aqueous solution of hydrochloric acid containing about 150 to about 300 ppm, calculated as palladium metal, of a palladium compound and about 10 to about 22 g/l, calculated as tin metal, of an stannous compound.

The treatment with the colloidal solution is carried out by immersing the substrate to be treated in a colloidal solution at about 10 to about 50° C., preferably about 25 to about 45° C. for about 2 to about 10 minutes, preferably about 3 to about 5 minutes. The treatment can form a uniform catalytic film on the surface of the substrate.

Then, an electrically conductive coating is formed on the plastic molded product with the catalyst applied, using an electroless copper plating solution.

In the method of the invention, it is essential to use an electroless copper plating solution comprising a copper compound, a saccharide having a reducing property, a complexing agent and an alkali metal hydroxide. When said electroless copper plating solution is used, an electrically conductive thin coating can be formed on the substrate to be treated without developing a bridge deposit. The thin coating is produced presumably due to the following deposition mechanism.

The saccharide contained as the reducing agent in said electroless copper plating solution has a significantly lower reducing power than paraformaldehyde or the like conventionally used in known electroless copper plating solutions. Consequently a thin coating of copper is deposited by reduction only on the palladium portion as a catalyst metal, but not on the tin portion having no catalytic property, whereby the development of bridge deposit is prevented. The incompletely metalized tin salt deposited on the substrate is partly reduced by the electroless plating solution and partly dissolved. Then, the metalized tin is replaced by copper and the copper is deposited on the substrate while the dissolved-out tin is complexed by a complexing agent and is presumably stabilized thereby.

Examples of the copper compound incorporated in the electroless copper plating solution are copper sulfate, copper chloride, copper carbonate, copper oxide, copper hydroxide and the like. The amount of the copper compound used is about 0.1 to about 5 g/l, preferably about 0.8 to about 1.2 g/l, calculated as copper metal. When the amount of the copper metal used is less than 0.1 g/l, an electroless plated copper coating is insufficiently formed, and undesired deposition is induced by electroplating in the subsequent step. Hence the lesser content is undesirable. On the other hand, if the amount of the copper metal used exceeds 5 g/l, no effect is produced by the increase of copper concentration and the required amount of the complexing agent is increased in proportion to the copper concentration, resulting in economical disadvantage and in difficulty of effluent treatment.

Examples of the saccharide having a reducing property which is incorporated in the electroless copper plating solution are grape sugar, glucose, sorbitol, cellulose, cane sugar, mannitol, gluconolactone, etc. The amount of the saccharide used is about 3 to about 50 g/l, preferably about 10 to about 20 g/l. If less than 3 g/l of saccharide is used, a copper coating is insufficiently formed by electroless plating, and electroplating entails a lower deposition capability in the subsequent step. Hence it is undesirable. On the other hand, above 50 g/l, the stability of electroless copper plating solution is lowered and a plated coating tends to show an inferior appearance. Hence it is undesirable.

Examples of the complexing agent to be incorporated into the electroless copper plating solution are hydantoin compounds, organic carboxylic acids, and the like. Useful hydantoin compounds are, for example, hydantoin, 1-methylhydantoin, 1,3-dimethylhydantoin, 5,5-dimethylhydantoin, allantoin, etc. Examples of the organic carboxylic acid are citric acid, tartaric acid, succinic acid and salts of these acids. The complexing agents can be used either alone or in combination.

The amount of the complexing agent used is about 2 to about 50 g/l, preferably about 10 to about 40 g/l. If less than 2 g/l of the complexing agent is used, the complexing power is insufficient, and the ability to dissolve copper is unsatisfactory, whereas the amount exceeding 50 g/l enhances the ability to dissolve copper but leads to economical disadvantage and difficulty of effluent treatment. Hence it is undesirable.

Further, since the saccharide with a low reducing power is used as a reducing agent in said electroless plating solution, a hydantoin compound with a relatively low complexing power can be used as a complexing agent without lowering the stability of the plating solution. When a plating solution contains a hydantoin compound with a relatively low complexing power as a complexing agent, the solution has a high deposition capability and effluent treatment is facilitated. The above hydantoin compound has a slight complexing power for the tin salt drawn into the plating solution from the catalyst solution used in the preceding step and thus can prevent adverse influence which arises from the tin salt. Consequently, it is suitable to use as the complexing agent a hydantoin compound alone or in combination with an organic carboxylic acid. In the combined use, the amount of the organic carboxylic acid is 50% by weight or less, preferably 20% by weight or less, based on the hydantoin compound used.

The foregoing electroless copper plating solution essentially contains an alkali metal hydroxide. Sodium hydroxide, potassium hydroxide, lithium hydroxide and the like are suitably used as the alkali metal hydroxide in view of availability and costs. These alkali metal hydroxides can be used either alone or in combination. The amount of the alkali metal hydroxide used is about 10 to about 80 g/l, preferably about 30 to about 50 g/l. Less than 10 g/l of alkali metal hydroxide results in insufficient formation of electroless plated copper coating and leads to a reduced deposition capability in electroplating over the range of low current density in the subsequent step. Hence it is undesirable. On the other hand, if the amount of the alkali metal hydroxide used is above 80 g/l, the solubility of copper is decreased and the stability of the plating solution is lowered, with an increase in the concentration of the hydroxide. Hence it is undesirable.

In preparation of said electroless copper plating solution, it is preferred to properly adjust the combination of components to be used and the specific proportions of the components within the above-mentioned proportion range of the components, such that the pH of the electroless plating solution is in the range of 10.0 to 14.0, preferably 11.5 to 13.5.

Optionally said electroless plating solution may further contain yellow prussiate, rhodanate and the like as a stabilizing agent. Since said electroless plating solution has a high stability, the solution can maintain the high stability without use of a stabilizing agent or with use of a small quantity, e.g. a few mg/l, of a stabilizing agent of low stabilizing power such as tannic acid, rhodanine or the like.

In treatment with the electroless plating solution, the temperature of electroless copper plating solution is about 20 to about 70° C., preferably about 35 to about 50° C. and the substrate to be treated is immersed in this plating solution for about 30 seconds to about 20 minutes, preferably about 3 to about 5 minutes. If the temperature of the plating solution is less than 20° C., a coating is insufficiently formed by electroless plating. On the other hand, if the temperature of the plating solution is higher than 70° C., the solution is given a low stability. Hence it is undesirable. If the substrate to be treated is immersed in the plating solution for less than 30 seconds, a coating is insufficiently formed by electroless plating. On the other hand, if the immersion time is longer than 20 minutes, the resulting effect is not higher than the effect achieved in the optimum range, and the productivity is lower. Hence it is undesirable.

An electrically conductive very thin coating is formed on the surface of the substrate and electroplating can be conducted directly on the coating. The obtained electrically conductive coating does not consist of copper alone. When the coating was dissolved in aqua regia and was analyzed by ICP, it was confirmed that the coating contained copper, palladium and tin.

Subsequently the substrate thus treated is electroplated in the conventional manner. Useful electroplating baths are not limited and can be any of conventional electroplating baths. The electroplating conditions can be conventional.

Electroplating methods for a decorating purpose comprising successively electroplating a substrate with copper, nickel and chromium are specifically described below as an example of electroplating methods.

A conventional bright copper sulfate plating solution can be used as a copper sulfate plating solution. For example, a plating bath to be used in the invention is prepared by adding a conventional brightener to an aqueous solution containing about 100 to about 250 g/l of copper sulfate, about 20 to about 120 g/l of sulfuric acid, and about 20 to about 70 ppm of chlorine ions. Copper sulfate plating conditions may be conventional. For example, electroplating is conducted at a plating solution temperature of about 25° C. and a current density of about 3 A/dm$^2$ and is continued until a deposit of the predetermined thickness is obtained.

A usual Watts bath can be used as a nickel plating solution. Useful baths are prepared by adding a commercially available brightener for a nickel plating bath to an aqueous solution containing about 200 to about 350 g/l of nickel sulfate, about 30 to about 80 g/l of nickel chloride and about 20 to about 60 g/l of boric acid. Nickel plating conditions may be conventional. For example, electroplating is conducted at a plating solution temperature of about 55 to about 60° C. and a current density of about 3 A/dm$^2$ and is continued until a coating of the predetermined thickness is obtained.

A usual Sargent bath can be used as a chromium plating solution. Useful baths include an aqueous solution containing about 200 to about 300 g/l of chromic anhydride and about 2 to about 5 g/l of sulfuric acid. Chromium plating conditions are, for example, a plating solution temperature of about 45° C. and a current density of about 20 A/dm$^2$, and the electroplating is continued until a deposit of the predetermined thickness is obtained.

According to the present invention, the following remarkable effects can be produced.

(1) Because the electroplating method of the invention does not cause a bridge deposit which is likely to occur at the electroless plating step in conventional methods of plating on plastics, a stardust-free coating with an esthetically pleasing appearance can be formed without cumbersome treatment such as brushing.

(2) The coating formed from the electroless plating solution for use in the invention has a suitable electrical conductivity and the electroplated coating of uniform thickness can be formed on said coating in a short time. Because of this benefit, an electroplated coating with a superior appearance can be formed on a large-size substrate by simple plating methods.

(3) The method of the invention eliminates the need to effect the activation treatment (accelerator treatment) frequently done after applying the catalyst in the conventional plating method, and thus the method is simplified.

(4) The method of the invention can prevent the occurrence of erosion blister which is likely to develop when an electroless nickel plating solution is used as an electroless plating solution.

(6) Since the electroless copper plating solution for use in the method of the invention contains a saccharide with relatively low reducing power as a reducing agent, the plating solution is insusceptible to decomposition and has a high stability. Consequently a satisfactory effect can be achieved without use of the stabilizing agent contained in conventional electroless plating solutions or with use of a stabilizing agent having a low stabilizing power. Because of this feature, the plating is unlikely to stop due to the excess of a stabilizer, and the plating solution is insusceptible to decomposition attributable to the lack of a stabilizer. Accordingly, the plating solution is easy to control.

(7) Even if the electroless copper plating solution contains a hydantoin compound with low complexing power as a complexing agent, the stability of the solution is not lowered. Thus when a hydantoin compound is used as the complexing agent, the electroless plating solution is improved in deposition capability and effluent treatment is facilitated.

(8) The electroless copper plating solution is not only used in the plating method of the invention but also effectively used in pre-treatment for electroplating on ceramics.

BEST MODE OF CARRYING OUT THE INVENTION

The present invention is described below in more detail with reference to the following Examples.

EXAMPLE 1

A substrate to be treated was an automotive emblem made of an ABS resin (product of Mitsubishi Rayon Co. Ltd., trade name "3001 M"), measuring 17 cm×3.8 cm ×0.3 cm (thickness) and having a surface area of about 1.3 dm$^2$. A jig for use in plating operation had two contact points for contact with the substrate to be treated, the two contact points being spaced away by 11 cm. The jig was one constructed from a stainless steel rod and had a contact point portion with a diameter of 2 mm. The other portion than the contact points was coated with a vinyl chloride sol, followed by baking.

First of all, the substrate to be treated was set in the jig, was immersed in a solution of an alkaline degreasing agent (product of Okuno Chemical Industries Co., Ltd., trade name "ACE CLEAN A-220", aqueous solution containing 50 g/l of the product) at 50° C. for 5 minutes, was washed with water and was immersed in an etching solution which was an aqueous solution containing 400 g/l of chromic anhydride and 400 g/l of sulfuric acid at 67° C. for 10 minutes to give a rough surface to the resin substrate. Thereafter the substrate was washed with water, immersed in an aqueous solution containing 50 ml/l of 35% hydrochloric acid and 10 ml/l of a reducing agent (product of Okuno Chemical Industries Co., Ltd., trade name "TOP CATCH CR-200") at room temperature for 30 seconds to remove the chromic acid from the surface of resin substrate and washed well with water.

Then, a pre-dip treatment was carried out by dipping the substrate into an aqueous solution containing 250 ml/l of 35% hydrochloric acid at 25° C. for 1 minute. Thereafter the substrate was immersed in a colloidal solution containing 330 mg/l of palladium chloride (200 mg/l of Pd), 35 g/l of stannous chloride (18.5 g/l of Sn), and 350 ml/l of 35% hydrochloric acid with a pH of 1 or less at 45° C. for 4 minutes to cause a catalyst to uniformly adhere to the resin substrate.

Thereafter the substrate was washed with water and electroless plating operation was conducted using the following electroless plating solutions.

Bath 1 of the invention

| | |
|---|---|
| Copper sulfate | 4 g/l |
| Hydantoin | 20 g/l |
| Glucose | 20 g/l |
| Sodium hydroxide | 40 g/l |
| pH | 12.6 |
| Temperature | 40° C. |
| Time | 5 minutes |

Bath 2 of the invention

| | |
|---|---|
| Copper sulfate | 4 g/l |
| 1-Methylhydantoin | 20 g/l |
| Sorbitol | 15 g/l |
| Potassium hydroxide | 45 g/l |
| pH | 12.8 |
| Temperature | 40° C. |
| Time | 5 minutes |

Bath 3 of the invention

| | |
|---|---|
| Copper sulfate | 4 g/l |
| 1,3-Dimethylhydantoin | 25 g/l |
| Glucose | 20 g/l |
| Sodium hydroxide | 25 g/l |
| Lithium hydroxide | 20 g/l |
| pH | 12.8 |
| Temperature | 40° C. |
| Time | 5 minutes |

Bath 4 of the invention

| | |
|---|---|
| Copper sulfate | 3.5 g/l |
| Allantoin | 15 g/l |
| Cane sugar | 15 g/l |
| Sodium hydroxide | 25 g/l |
| Lithium hydroxide | 40 g/l |
| pH | 13.8 |
| Temperature | 40° C. |
| Time | 5 minutes |

Bath 5 of the invention

| | |
|---|---|
| Copper sulfate | 5 g/l |
| Hydantoin | 20 g/l |
| Gluconolactone | 10 g/l |
| Potassium hydroxide | 25 g/l |
| Lithium hydroxide | 30 g/l |
| pH | 13.0 |
| Temperature | 40° C. |
| Time | 5 minutes |

Bath 6 of the invention

| | |
|---|---|
| Copper sulfate | 4 g/l |
| 1-Methylol-5,5-dimethylhydantoin | 20 g/l |
| Cane sugar | 10 g/l |
| Sodium hydroxide | 25 g/l |
| Lithium hydroxide | 40 g/l |
| pH | 13.0 |
| Temperature | 40° C. |
| Time | 5 minutes |

Bath 7 of the invention

| | |
|---|---|
| Copper sulfate | 5 g/l |
| Citric acid | 10 g/l |
| Hydantoin | 20 g/l |
| Grape sugar | 10 g/l |
| Potassium hydroxide | 25 g/l |
| Lithium hydroxide | 40 g/l |
| pH | 13.0 |
| Temperature | 40° C. |
| Time | 4 minutes |

Bath 8 of the invention

| | |
|---|---|
| Copper sulfate | 4 g/l |
| Tartaric acid | 20 g/l |
| Mannitol | 10 g/l |
| Sodium hydroxide | 25 g/l |
| Lithium hydroxide | 35 g/l |
| pH | 12.8 |
| Temperature | 40° C. |
| Time | 5 minutes |

-continued

Comparative Bath 1

| | |
|---|---|
| Copper sulfate | 10 g/l |
| Sodium potassium tartarate | 25 g/l |
| Formaldehyde | 10 g/l |
| 2,2-Dipyridyl | 1 mg/l |
| pH | 12.4 |
| Temperature | 25° C. |
| Time | 10 minutes |

Comparative Bath 2

| | |
|---|---|
| Copper sulfate | 12 g/l |
| EDTA · disodium salt | 35 g/l |
| Formaldehyde | 10 g/l |
| Sodium cyanide | 5 mg/l |
| pH | 12.2 |
| Temperature | 40° C. |
| Time | 7 minutes |

Comparative Bath 3

| | |
|---|---|
| Nickel sulfate | 25 g/l |
| Citric acid | 20 g/l |
| Ammonium chloride | 20 g/l |
| Sodium hypophosphite | 18 g/l |
| Lead nitrate | 1 mg/l |
| pH | 9.0 |
| Temperature | 40° C. |
| Time | 8 minutes |

Then, the substrate was washed well with water and was subjected, as held in the jig, to the subsequent copper electro-plating step. A copper plating solution was prepared by adding 5 ml/l of "CRP Copper MU" and 0.5 ml/l of "CRP Copper A" (trade names, products of Okuno Chemical Industries Co., Ltd.) as a brightener to an aqueous solution containing 250 g/l of copper sulfate, 50 g/l of sulfuric acid, and 50 ppm of chlorine ions. A copper electroplating operation was performed at a plating solution temperature of 25° C. and a current density of 3 A/dm$^2$ for 20 minutes using a plate of phosphorus-containing copper as an anode and the substrate to be plated as a cathode while effecting slow air agitation.

Then, the substrate was washed with water and electroplated with nickel. A nickel electroplating solution was prepared by adding 20 ml/l of "ACNA B-1" and 20 ml/l of "ACNA B-2," (trade names, products of Okuno Chemical Industries Co., Ltd.) as a brightener to an aqueous solution containing 250 g/l of nickel sulfate, 50 g/l of nickel chloride and 40 g/l of boric acid. A nickel electroplating operation was performed at a plating solution temperature of 50° C. and a current density of 4 A/dm$^2$ for 15 minutes using a plate of pure nickel as an anode and the substrate to be plated as a cathode while effecting slow air agitation.

Next, the substrate was washed with water and electroplated with chromium using, as a chromium plating solution, an aqueous solution containing 250 g/l of chromic anhydride (trivalent chrome 3 g/l ) and 2.0 g/l of sulfuric acid with a plate of lead as an anode and the substrate to be plated as a cathode at a plating solution temperature of 50° C. and a current density of 25 A/dm$^2$ for 1 minute without agitation.

Some properties of the plated coatings formed by the above-mentioned method and some properties of the electroless plating solutions used were evaluated by the following methods with the results set forth below.

Deposition Capability of Electroplating (Evaluation method) A period of time was determined until an automotive emblem used as a substrate to be plated is covered with copper over its entire surface of the emblem within a copper electroplating solution.

(Results) It took about 38 seconds to cover the entire surface of the automotive emblem with each of Comparative Baths 1–3 used as conventional electroless plating solutions, whereas it took about 50 seconds to cover the entire surface thereof with each of Baths of the Invention 1–8. However, this difference scarcely affected the productivity.

Appearance of Coating After Electroplating (Evaluation method) The occurrence or non-occurrence of pit and stardust and the degree of gloss after plating with chromium were evaluated by visual inspection. (Results) When Baths of Inventions 1–8 were used, coatings of esthetically pleasing appearance were formed, and no flaw was found on the surface of each coating. On the other hand, when Comparative Bath 3 was used, the coating was imparted relatively good appearance and only a few pits and a little stardust were found. When Comparative Baths 1 and 2 were used, pits and stardust were developed.

Adhesion (Evaluation method) A plate of ABS resin, 100 mm×100 mm, was coated by electroless plating and a copper coating of 50 $\mu$m thickness was formed by copper sulfate electroplating on the plate. The coating was cut to the surface of the ABS resin plate to give cuts with 10 mm width. The coating was peeled with an autograph and the peel strength was determined.

(Results) When Baths 1–8 of the invention were used, the strength was in the range of 1150 to 1280 g and average strength was 1220 g. The use of Comparative Bath 1 resulted in strength of 940 g; the use of Comparative Bath 2, strength of 980 g; and the use of Comparative Bath 3, strength of 1010 g. All of comparative baths showed a lower adhesion than the baths of the invention.

Solution Stability (Evaluation method) Plating operation was carried out using each of Baths 1–8 of the invention and Comparative Baths 1–3 at a total deposition area of 1.5 $dm^2$ per liter and the same procedure was repeated 5 times. Thereafter Baths 1–8 of the invention were left to stand at 70° C.; Comparative Bath 1, at 35° C.; Comparative Bath 2, at 70° C.; and Comparative Bath 3, at 60° C. A time period from the start of standing at such temperature until inducement of decomposition was determined.

(Results) No decomposition occurred even after a time lapse of 200 hours with respect to Baths 1–8 of the invention. On the other hand, decomposition arose 22 hours later with respect to Comparative Bath 1, 8 hours later with respect to Comparative Bath 2 and 66 hours later with respect to Comparative Bath 3, which means that the comparative baths had a low stability.

Solution Controllability (Evaluation method) Coatings were produced by electroless plating under various conditions of the concentration of metals, pH, temperature and time with respect to Baths 1–8 of the invention and Comparative Baths 1–3. Then the coatings were electroplated with copper in the subsequent step to determine the range of conditions in which a coating was deposited by electroplating.

(Results) A coating was formed by electroplating from the baths of the invention under a wider range of each item of conditions than the comparative bath. This confirmed that it was easier to control the baths of the invention.

Effluent Treatment (Evaluation method) Baths 1–8 of the invention and Comparative Baths 1–3 were diluted to specific metal concentrations and were subjected to pH adjustment, coagulation, precipitation and filtration as done in a usual method of disposing waste water after which the amounts of remaining metals were measured.

(Results) Baths 1–6 of the invention showed 3–5 ppm in the concentration of remaining metals; Bath 7 of the invention, 22 ppm; and Bath 8 of the invention, 42 ppm, whereas Comparative Bath 1 displayed 40 ppm in the concentration of remaining metals; Comparative Bath 2, 65 ppm; and Comparative Bath 3, 48 ppm. As apparent from the results, Baths 1–7 of the invention using a hydantoin compound as a complexing agent showed lower concentrations of remaining metals than the comparative baths. Especially significantly lower remaining metal concentrations were exhibited by Baths 1–6 of the invention containing hydantoin alone.

As is clear from the results described above, Baths 1–8 of the invention showed higher performance characteristics in any of appearance, adhesion, solution stability, range in which the solution should be controlled, and ease of effluent treatment than the comparative baths. The baths of the invention exhibited a slightly lower deposition capability in electroplating than the comparative baths. However, since copper sulfate electroplating is generally effected for at least 30 to 60 minutes, the difference in the deposition capabiltity scarcely affects the productivity. Thus the experiments confirmed excellent industrial usefulness of the plating solution of the invention.

What is claimed is:

1. A method of electroplating non-conductive plastic moldings, the method comprising the steps of: applying a catalyst useful for electroless plating to non-conductive plastic moldings using a colloidal solution containing a precious metal compound and a stannous compound; forming an electrically conductive coating on the surface of the moldings using an electroless copper plating solution consisting essentially of a copper compound, a reducing agent consisting of at least one saccharide having a reducing property, a complexing agent and an alkali metal hydroxide; and electroplating the coated moldings wherein the electroless copper plating solution has a pH of 10 to 14 and the reducing agent is contained in the electroless copper plating solution in amounts sufficient to function as a reducing agent.

2. The method according to claim 1, wherein the electroless copper plating solution is an aqueous solution comprising 0.1 to 5 g/l, calculated as copper metal, of the copper compound, 2 to 50 g/l of the complexing agent, 3 to 50 g/l of the saccharide having a reducing property, and 10 to 80 g/l of the alkali metal hydroxide.

3. The method according to claim 1 or 2, wherein the saccharide having a reducing property is at least one selected from the group consisting of grape sugar, glucose, sorbitol, cellulose, cane sugar, mannitol and gluconolactone, and wherein the complexing agent is at least one selected from the group consisting of hydantoin compounds and organic carboxylic acids.

4. The method according to claim 1 or 2, wherein the complexing agent is a hydantoin compound alone or a mixture of a hydantoin compound and an organic carboxylic acid, the amount of the organic carboxylic acid being 50% by weight or less of the hydantoin compound.

5. The method according to claim 1 or 2, wherein the electroless copper plating solution has a pH of 10 to 14 and a solution temperature of 20 to 70° C.

* * * * *